United States Patent [19]

Cyphert

[11] 3,959,844

[45] June 1, 1976

[54] CARPET SOIL EXTRACTOR

[75] Inventor: Gilbert G. Cyphert, Phoenix, Ariz.

[73] Assignee: Chemko Industries, Inc., Phoenix, Ariz.

[22] Filed: Feb. 5, 1975

[21] Appl. No.: 547,139

[52] U.S. Cl. ..... 15/320; 15/353; 15/398

[51] Int. Cl.[2] ..... A47L 7/00

[58] Field of Search ..... 15/302, 320, 321, 322, 15/350, 353, 50 R, 363, 398, 400

[56] References Cited

UNITED STATES PATENTS

| | | | |
|---|---|---|---|
| 1,923,689 | 8/1933 | Rosenberg | 15/320 |
| 2,726,807 | 12/1955 | Lewis | 15/320 X |
| 2,791,964 | 5/1957 | Reeve | 15/353 X |
| 2,910,720 | 11/1959 | Smith | 15/320 |
| 3,117,337 | 1/1964 | Krammes | 15/320 |
| 3,273,193 | 9/1966 | Soderholm et al. | 15/320 |
| 3,392,418 | 7/1968 | Schowalter | 15/320 |
| 3,402,420 | 9/1968 | Schaefer | 15/320 |
| 3,619,849 | 11/1971 | Jones | 15/322 X |
| 3,699,607 | 10/1972 | Putt | 15/320 |
| 3,828,390 | 8/1974 | Cater | 15/353 X |

*Primary Examiner*—Edward L. Roberts
*Attorney, Agent, or Firm*—Cahill, Sutton & Thomas

[57] ABSTRACT

A self-contained carpet soil extractor requiring only external contacts to electricity, water and a waste drain is disclosed. A cleaning agent is automatically mixed with water, sprayed on the pile of the carpet, agitated into the pile to loosen and flush any dirt to the surface, and the grimy solution is removed by the apparatus. The dirt is then filtered from the liquid which is pumped to the waste drain.

6 Claims, 3 Drawing Figures

39
10
11
51
47
46
14'
52
53
16
18
13
34
17
37
14
12
58
38
57
21
17'
56
22
23

CARPET SOIL EXTRACTOR

FIELD OF THE INVENTION

This invention relates to carpet cleaning apparatus in general and in particular to such apparatus where all cleaning components are combined in a single, self-contained unit.

BACKGROUND OF THE INVENTION

It is well known that carpets which are cleaned regularly not only have a better appearance, but also wear significantly longer than carpets that are permitted to carry traffic while they are filled with dirt. Many of the individual particles that would make up the dirt on a carpet are abrasive in nature. Therefore, continual traffic on a dirty carpet simply works to abrade the backing and pile of the carpet by forcing the dirt into the carpet. For this reason, carpet manufacturers recommend periodic cleaning of carpets. Although it is possible to pick up a carpet and transport it to a facility for cleaning, many carpets cannot be readily moved from their location. Wall-to-wall carpet installations are semipermanent in nature and it is not contemplated that once a carpet is installed in this fashion that it would be removed for cleaning or any other purpose. Also, a carpet which covers an extremely large area would be heavy and difficult to remove for cleaning purposes. It can be readily understood that in many installations, it is particularly advantageous if the carpet can be cleaned in place rather than being removed to some distant point for cleaning.

Many cleaning methods apply water to the carpet being cleaned. Unless great care is taken, the water can create substantial problems. Among these problems are: the backing material of many carpets shrinks or decomposes when wet; underlying surfaces, such as oak flooring, are ruined by water; any dye which is not waterfast will run or fade; all normal traffic must be re-routed since the wet carpet cannot be walked on; and, all furniture must be removed from the entire carpet surface since the wet carpet would be marked by their presence while the carpet was drying.

Considering the practicality of using water to clean a carpet, and considering the many disadvantages of having that water saturate the carpet or stay in the carpet for any significant period of time, it can be appreciated that an effective and preferred carpet soil extractor would be one which is capable of removing the applied water from the carpet immediately and completely.

Accordingly, a primary object of my invention is to provide a carpet soil extractor that utilizes water for cleaning, yet leaves the carpet substantially dry at the conclusion of the cleaning process.

It is well known to distribute a cleaning agent on the surface of a carpet, agitate the cleaning agent into the pile of the carpet to loosen the retained dirt, and then vacuum the combination of dirt and cleaning agent from the carpet surface. Commonly, the cleaning and extracting of the cleaning agent are separate operations. The first operation loosens the soil from the carpet pile and a second operation removes the cleaning agent and soil from the carpet.

U.S. Pat. No. 3,699,607, issued Oct. 24, 1972, to F. E. Putt, discloses a carpet cleaning apparatus including a plurality of nozzles for directing a flow of water at an angle to the pile of the carpet to be cleaned. A rotary brush agitates the pile of the carpet following which a vacuum or suction chamber picks up the water and any entrained dirt. This apparatus requires a separate vacuum source for creating the pick-up suction to remove the water and soil from the carpet surface. Also, such apparatus requires great care in its use since the powered brushes of the apparatus may permanently damage the carpet.

It is therefore an object of my invention to provide carpet soil extracting apparatus in which all of the machinery required to apply a cleaning agent, agitate it into the pile of the carpet and remove the cleaning agent and any soil from the surface of the carpet is housed in a self-contained single piece of equipment.

It is also an object of my invention to provide carpet soil extracting apparatus having a fixed position brush to prevent inadvertent damage to the carpet being cleaned.

Water is relatively ineffective for loosening the soil that accumulates on the surface of a carpet. Further, any oily residue is generally impervious to water. Therefore, in many applications it is advantageous to use a water solution containing a grease cutting and cleaning agent rather than pure water. Prior art devices, such as that disclosed by Putt, make no provision for the use of such cleaning agents. They would require mixture with the incoming water supply before its delivery to the cleaning apparatus.

It is yet another object of my invention to provide apparatus that automatically mixes a cleaning agent with the incoming water supply in proximity to the cleaning solution discharge point.

These and other features and objects of my invention, will be more readily understood by reading the following detailed description in conjunction with the drawings.

SUMMARY OF THE INVENTION

This invention utilizes a plurality of nozzles to direct jets of cleaning solution against a soiled carpet. The cleaning solution is obtained by automatically mixing a cleaning agent with incoming water from an external source. The solution is urged into the pile of the carpet to loosen any dirt and flush it to the surface. The carpet is then vacuumed clean and substantially dry.

DETAILED DESCRIPTION OF AN ILLUSTRATIVE EMBODIMENT

Figures 1, 2:
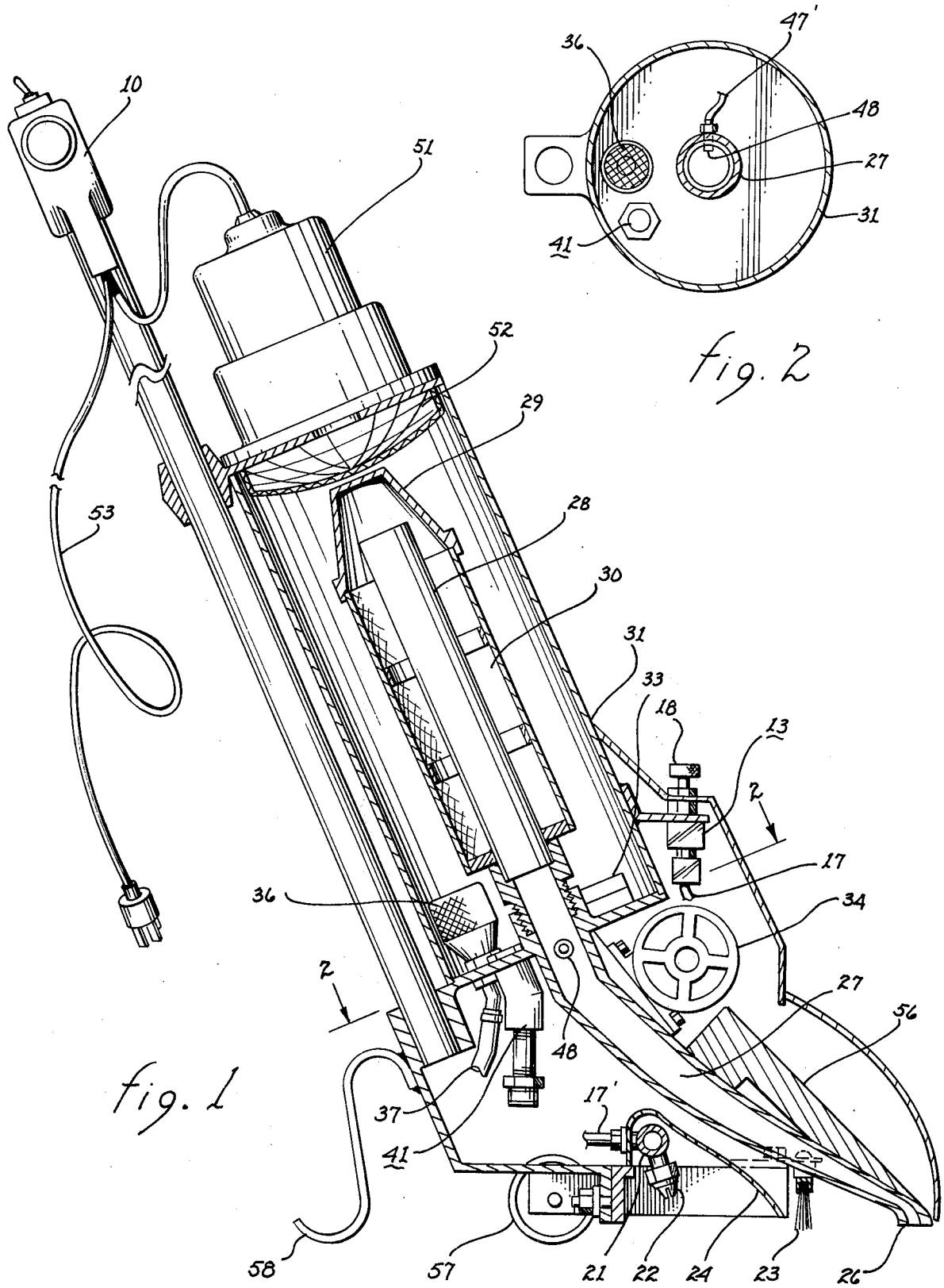
FIG. 1 is a partial cross-sectional view of apparatus embodying my invention.
FIG. 2 is a cross-section view taken along the lines indicated in FIG. 1.
Figure 3:
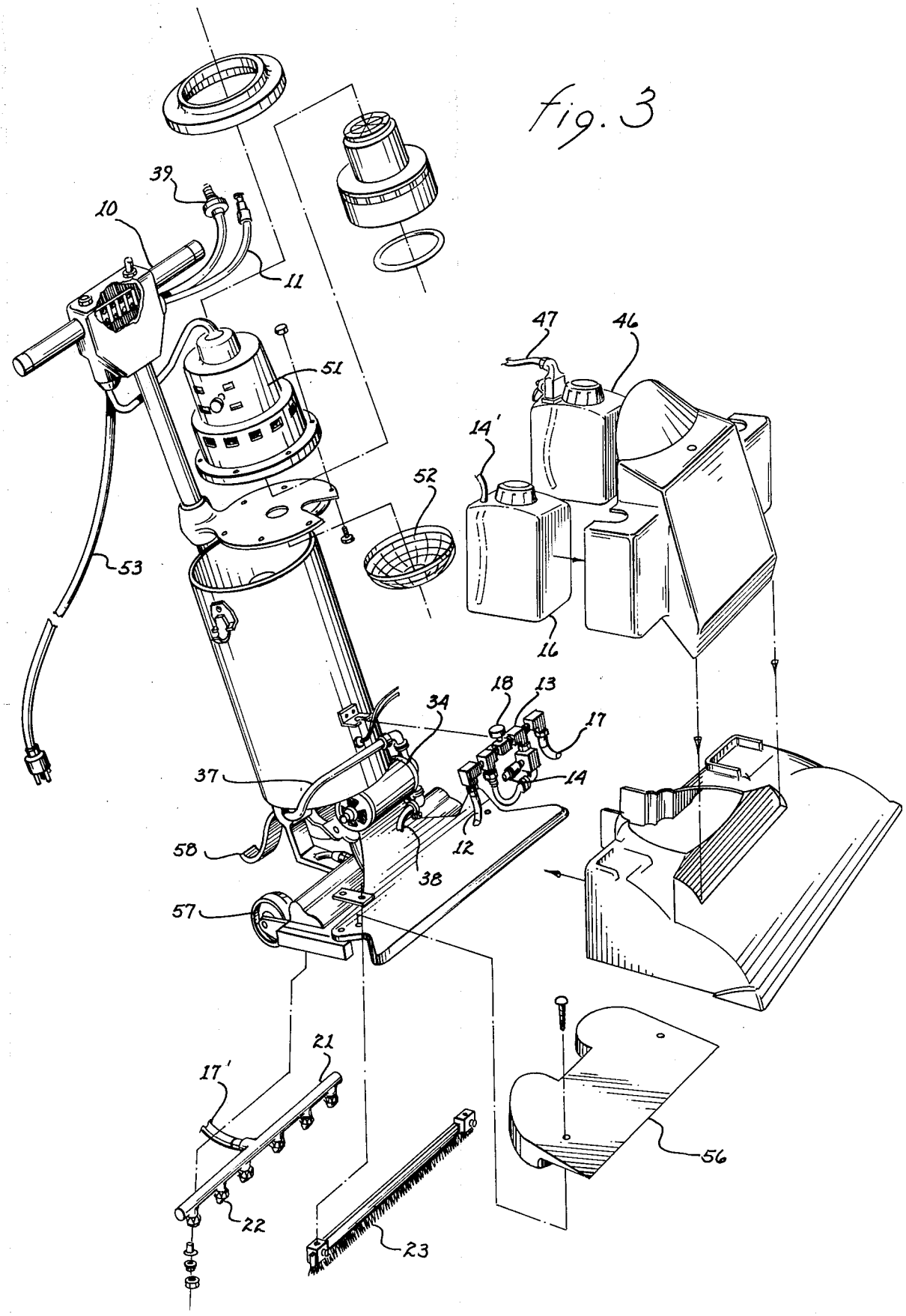
FIG. 3 is an exploded prospective view of the equipment shown in FIG. 1.

To utilize the carpet soil extractor depicted in FIG. 1, the operator would stand behind the unit and grasp handle 10, pulling the machine toward himself to move the unit across the carpet. The carpet soil extractor is designed to move from right to left as shown in FIG. 1 across the surface of the soiled carpet. As shown in FIG. 3, the carpet soil extractor has three external connections: an incoming water line 11 connected to any convenient source of clean water; a waste discharge line 39 connected to any available sewer line or other waste receptacle; and an electrical power cord 53 connectable to any convenient electrical outlet.

Incoming water line 11 connects to the extractor in the vicinity of handle 10. An internal connection extends to a mixer-inlet line 12 located in the approximate center of FIG. 3. Mixer-inlet line 12 provides clean water to a mixer valve assembly 13. Also connecting to mixer valve assembly 13 is a cleanser inlet line 14 which in turn attaches to an outlet line 14' from a cleanser reservoir 16. A concentrated cleaning agent may be stored in cleanser reservoir 16 for delivery automatically to valve assembly 13 in response to the flow of water from inlet line 12. Mixer valve assembly 13 mixes the agent with the water entering the valve through inlet line 12 and discharges a cleaning solution from mixer outlet line 17. A mixer adjustment knob 18 is provided to adjust the concentration of the cleaning solution discharged from valve assembly 13 through outlet line 17.

Outlet line 17 connects to metering tube 21 at inlet 17'. Connected to metering tube 21 are a plurality of jet nozzles 22. Referring to FIG. 1, it can be seen that jet nozzles 22 direct a jet of cleaning solution at the pile of the carpet beneath the apparatus at a substantial angle to the surface of the carpet. As the apparatus is moved toward the left in FIG. 1, an agitator brush 23 stimulates the cleaning solution to penetrate the pile and loosen any ground-in soil present in the pile of the carpet. Brush 23 gently fluffs and separates the matted nap of the carpet. A separation shroud 24 encloses the nozzle area to prevent the cleanser solution jet from splattering beyond the area immediately under jet nozzles 22.

After the jet of cleanser solution has been discharged by jet nozzles 22 to entrain any loose dirt in the pile of the carpet, and brush 23 has loosened the ground-in soil present in the pile of the carpet, the continued movement of the apparatus to the left in FIG. 1 brings a pickup mouth 26 over the area of the carpet where the dirt and soil have been loosened. Pickup mouth 26 connects through delivery tube 27 which in turn connects to a discharge tube 28. As will be described later, a vacuum or suction effect is created at mouth 26. The cleanser solution and all of the loosened dirt and soil are drawn up through mouth 26 and delivered through tube 27 to the discharge tube 28. As the liquid solution and the intermixed dirt and soil leave discharge tube 28, they strike a deflector 29, causing the mixture to move down and outward from tube 28.

The liquid solution and the suspended dirt and soil are filtered by a separator screen 30 to separate a substantial portion of the dirt and soil from the liquid portion of the discharge. The liquid discharge passes through separator screen 30 and is collected in liquid holding tank 31. When the liquid level in holding tank 31 is sufficient to cause float 33 to rise to a predetermined level, a waste discharge pump 34 is actuated to pump the accumulated water to the waste drain. The accumulated liquid passes through a debris screen 36, then through a waste drain line 37 to pump 34. A pump outlet line 38 connects through the unit to a waste discharge line 39.

Holding tank 31 is also outfitted with an auxillary drain 41 which is used to ensure that tank 31 is completely drained at the end of a cleaning operation using the unit. Despite the agitating action of the cleaning operation, and the high airflow and turbulence of the vacuum pickup apparatus, it is important that the liquid delivered to tank 31 not be permitted to suds or foam. For this reason, the unit includes a defoaming solution reservoir 46 which connects through a defoamer delivery line 47 to an input line 47' as shown in FIG. 2. Input line 47' connects to a suction nozzle 48 which is positioned at the side wall of delivery tube 27. The dirty cleanser solution mixture moving through delivery tube 27 will mix with a quantity of the defoamer which is drawn from nozzle 48. This prevents tank 31 from being filled with sudsing solution. Since foam would not be pumped out of the tank 31 by pump 34, any suds that were permitted to enter tank 31 would accumulate without actuating the float and possibly enter the vacuum motor.

The vacuum required to draw cleaning solution from the surface of the carpet up through the delivery tube and into tank 31 is provided by a high capacity fan 51 which mounts on top of tank 31 and connects to the tank through a secondary air filter 52. Air filter 52 removes any airborne particles which may have entered tank 31 and which could otherwise come into contact with the blades of fan 51. The accumulation of dirt on fan 51 could create an imbalance situation which would rapidly deteriorate the bearings of the fan. A power cord 53 supplies power to fan 51.

To reduce operator fatique, a weight 56 is positioned over the area where brush 23 and mouth 26 are located. Thus, the operator need not continuously apply pressure to keep the unit in tight communication with the carpet. At the rear of the unit is one or more rollers 57 which permit the unit to be readily moved across the carpet. To provide stability when the unit is not being supported by an operator, a rest 58 is provided at the rear of the unit.

It has been determined that a 2-HP unit for fan 51 will remove approximately 90% of the moisture from a cleaned carpet. It is also recommended that tank 31 have a approximate capacity of 2–5 gallons. This provides sufficient holding capacity without substantially increasing the weight of the extractor. To facilitate manipulation of the extractor, water line 11, water discharge line 39 and power cord 53 should be approximately 50 feet long to permit access to convenient hookup locations without presenting a substantial obstacle to the mobility of the extractor. It should be obvious that these values are representational only. Many variations could be made to suit the specific needs of an intended application.

These and other modifications could be made by those skilled in the art without departing from the spirit and scope of the invention. For example, where hot water is not available at incoming water line 11, the extractor could be provided with a heating element.

I claim:

1. In a manually propelled carpet cleaning apparatus having an upwardly extending handle and roller means for supporting said apparatus and for serving as a pivot point about which said apparatus is pivoted into and out of operative engagement with the carpet, said apparatus including a source of incoming water, a container for housing a cleaning agent, a mixer for metering the cleaning agent into the incoming water to produce a cleaning solution and means for generating a partial vacuum, the improvement comprising in combination:

a. a plurality of nozzles for directing the cleaning solution onto and into the carpet;

b. a shroud disposed about said nozzles for limiting splatter of the cleaning solution;

c. non-rotary agitator brush means disposed external to said shroud for engaging the pile of the carpet and stimulating penetration of the cleaning solution into the pile to loosen dirt contained in the carpet;

d. mouth means disposed in contacting relationship with the carpet, said mouth means being in fluid communication with the vacuum means for scavenging the cleaning solution and loosened dirt from the carpet;

e. weight means for urging pivotal movement of said apparatus about the roller means to bias said agitator brush means and said mouth means against the pile of the carpet;

f. filter means disposed intermediate the vacuum means and said mouth means for removing the dirt contained within the scavenged cleaning solution, said filter means including deflection means for deflecting the cleaning solution away from the vacuum means; and g. a tank for receiving the filtered cleaning solution flowing through said filter means.

2. The improvement as set forth in claim 1 wherein said nozzle means, said agitator brush means and said mouth means are disposed laterally on the same side of the roller means and wherein the handle is disposed laterally on the opposite side of the roller means; whereby, a manually exerted downward force upon the handle causes said apparatus to pivot about the roller means and disengages said brush means and said mouth means from the carpet.

3. The improvement as set forth in claim 2 wherein said filter means is an upwardly extending cylindrically shaped filter and said deflector means is a downwardly opening cup shaped non-porous element disposed at the upper end of said filter and said mouth means includes a tube extending upwardly from said mouth means into said filter for discharging the scavenged cleaning solution with entrained dirt into said cup shaped element.

4. The improvement as set forth in claim 3 wherein said brush means comprises a downwardly directed and essentially vertically oriented row of bristles.

5. The improvement as set forth in claim 4 wherein said nozzle means includes a row of nozzles directed downwardly and toward said row of bristles.

6. In a manually propelled apparatus for cleaning soiled carpets, said apparatus including a set of axially aligned rollers disposed transverse to the direction of travel and serving as a pivot point for said apparatus, a handle extending from said apparatus lateral to the rollers and toward the direction of travel, a source of incoming water, a container for a cleaning agent, a mixer for metering the cleaning agent into the incoming water to obtain a cleaning solution and means for generating a partial vacuum, the improvement comprising in combination:

a. a row of nozzles for ejecting the cleaning solution into the pile of the carpet, said nozzles being positioned to trail the aligned rollers during operation of said apparatus;

b. a shroud disposed about said nozzles for constraining the splatter of the ejected cleaning solution;

c. a brush having downwardly directed bristles for agitating the pile of the carpet into which the cleaning solution has been ejected, said brush being positioned to trail said nozzles during operation of said apparatus, whereby said brush aids in loosening dirt within the pile;

d. an elongated mouth extending generally coincident with the width of the pile into which the cleaning solution has been ejected by said nozzles, said mouth being positioned to trail said brush during operation of said apparatus and including tube means for establishing fluid communication between the vacuum means and said mouth to draw the ejected cleaning solution and entrained dirt from the pile;

e. a weight for urging pivotal movement of said apparatus about the aligned rollers to bias said brush and said mouth against the pile;

f. a filter disposed intermediate said mouth and the vacuum means for removing the dirt entrained within the ejected cleaning solution, said filter including a deflector for deflecting the ejected cleaning solution from the vacuum means; and g. a tank for receiving the filtered cleaning solution flowing through said filter.

* * * * *